US005673581A

United States Patent [19]

Segal

[11] Patent Number: 5,673,581

[45] Date of Patent: Oct. 7, 1997

[54] METHOD AND APPARATUS FOR FORMING THIN PARTS OF LARGE LENGTH AND WIDTH

[76] Inventor: Vladimir Segal, 15719 E. Fourth Ave. #90, Veradale, Wash. 99037

[21] Appl. No.: 538,783

[22] Filed: Oct. 3, 1995

[51] Int. Cl.[6] ..... B21J 9/02

[52] U.S. Cl. ..... 72/184

[58] Field of Search ..... 72/184, 189, 190, 72/192, 207

[56] References Cited

U.S. PATENT DOCUMENTS

| | | | |
|---|---|---|---|
| 873,997 | 12/1907 | Ebinghaus et al. | 72/192 |
| 3,626,746 | 12/1971 | Pietryka | 72/189 |
| 4,608,848 | 9/1986 | Mele | 72/184 |

*Primary Examiner*—Lowell A. Larson
*Attorney, Agent, or Firm*—Ilya Zborovsky

[57] ABSTRACT

Method and apparatus for fabrication of large thin parts, such as panels having integral stiffeners arranged in any desired pattern, for superplastic and semisolid forming of complicated components, and for consolidation and bonding of powder and composite materials into flat products, include forging-rolling between a flat die and a circular die with a ratio of a contact length between the circular die and a billet to a billet thickness between 20–75 that prevents a material flow in a rolling direction and extrudes the material into die cavities. The circular die is formed as a ring-shaped element sliding along cylindrical guide surface. Both dies are displaced by press to squeeze and forge a billet into a product. For semicontinuous processing of very long parts, the dies are divided into a plurality of sectioned elements which are periodically introduced into a working zone.

7 Claims, 6 Drawing Sheets

METHOD AND APPARATUS FOR FORMING THIN PARTS OF LARGE LENGTH AND WIDTH

BACKGROUND OF THE INVENTION

The present invention relates to a method and an apparatus for forming thin parts of large lengths and widths such as light-weight panels and similar components having integral stiffeners arranged in any desired cellular pattern. Among them are complicated structural parts for airplane skins and frames, missile bodies, space vehicles, automobiles, ships and architectural structures.

Additionally, the invention also relates to consolidation and bonding of fibrous and composite materials into flat billets and long products such as sheets and plates.

At the present, most panels and large thin parts for aero-space applications having integral stiffeners are fabricated by machining or chemical milling processes. These operations are expensive, time-consuming, material-wasting, and they can not provide high quality products. Much more economical forming process in dies demands very powerful presses, and thus it may be applied to panels which have only a few square meters of area in projection.

Many efforts have been made to produce integrally stiffened parts by forging-rolling process. But as it was described by A. R. Bringewald in U.S. Pat. Nos. 3,415,059, they resulted in insignificant material extrusion into dies and a high percentage of material wasted. In the U.S. Pat. Nos. 3,415,059, an improvement of forging-rolling operation was suggested by using roll and flat dies with a special container to prevent material flow in the rolling direction. This complicated tool was not practical and the same inventor in his following U.S. Pat. Nos. 3,521,472 and Nos. 3,847,004 developed a step forging process. The Bringewald's method and apparatus were improved in U.S. Pat. Nos. 4,608,848, Nos. 4,770,020 and Nos. 4,907,436.

However, the step forging process presents several problems. Firstly, the tool is expensive and unreliable as it contains many precision parts which are movable under high pressure. Secondly, the process may be applied only for short panels due to the restriction of an available length of the dies. Thirdly, the process is unpractical, since all operations including die and billet assembly, heating, processing, cooling, disassembly, and product extraction are time-and-labor consuming. Fourthly, a problem exists in applications of the process to most integral stiffener patterns as location of fibs into the transverse direction should correspond to split planes of die segments. Otherwise, segments may produce laps and other surface defects in forgings. Also, the process can not be realized at ordinary presses and special machines have to be developed. Therefore, currently a sufficiently simple, practical and effective forming method for fabrication complicated panels and thin components of large length and width has not been developed.

SUMMARY OF THE INVENTION

It is therefore an object of the present invention to provide a method and an apparatus which overcome the foregoing and other problems in fabrication of integrally stiffened large panels and similar components. To this end and in accordance with the present invention, ordinary forging-rolling process between flat and circular sculptured dies is modified by selection of a large ratio of a billet/die contact area length to a billet thickness that is necessary to prevent material flow into longitudinal directions and extrude it into die cavities. The circular die of radius from 10 to 100 meters is formed as a sectoral block at the ring. Circular and flat dies glide correspondingly along cylindrical and plane guide surfaces defining a working zone. In the original position, preheated dies are located in front of the working zone and a heated billet is inserted between the dies. Then a press plunger acts simultaneously on both dies and pushes them through the working zone. During a press stroke, the dies successively squeeze and forge the billet into a product. After leaving the working zone, the dies are separated from a forging and moved back to the original position.

For fabricating very long panels, the method comprises a plurality sectioned circular and flat die blocks which are periodically introduced into the working zone from the entry end of the billet, pushed set-by-set through the working zone during semi-continuous strokes of the press, separated from the product after leaving the working zone, transferred to storage-preheating positions, and recycled to the original position in the prescribed order. Also, the method includes fabrication of flat long billets and products from fibrous composite materials.

The apparatus of the invention performs the forging-rolling process at horizontal extrusion presses. It comprises a frame mounted at a press traverse, two bases with circular and flat guide surfaces, means for fixing dies in an original position in front of the working zone, a loading mechanism of both dies, a mechanism for separation of a forged product from the dies after leaving the working zone, means for conveying the dies to storage-preheating positions, means for heating the dies, and means for heating and feeding the billet to the working zone. Another embodiments and details of the invention will be described in the patent description and claims.

BRIEF DESCRIPTION OF THE DRAWINGS

For a more complete understanding of the present invention and the advantages thereof, reference is now made for the following descriptions taken in conjunction with accompanying drawings in which.

DESCRIPTION OF THE PREFERRED EMBODIMENTS

Preferred embodiments of the invention will now be described with reference to the accompanying Figures.

Figure 1:
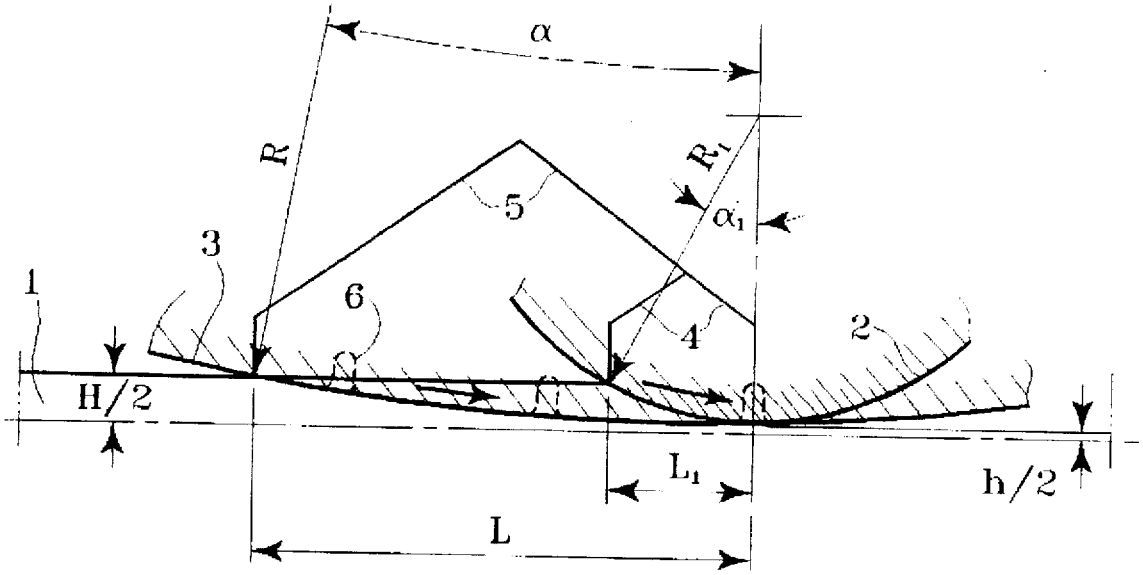
FIG. 1 shows the effect of the roll radii on a working zone of forging-rolling.

The method of the invention exploits an effect of roll radii on stress-strain state of a rolled material (FIG. 1, top half of a rolling zone is shown because of symmetry). The same reduction of a billet 1 may be achieved with small radii $R_1$ of rolls 2 and with large radii R of rolls 3. In the first case, a rolling angle $\alpha_1$ is large, but a ratio of the contact area length $L_1$ to the original billet thickness H is small. That promotes a material flow in the rolling direction and results in a low roll pressure 4. This case is effective to facilitate material reduction, especially for thin billets.

In the second case of large radii R, a rolling angle a is small, a ratio of the contact area length L to the billet thickness H is large, and a roll pressure 5 is high. As a result, a material flow in the rolling direction is suppressed. If the rolls are provided with sculptured dies 6 (FIG. 1), both these effects will promote a material extrusion into the die cavities 6. The larger the roll radii, the more material extrudes into the dies, in comparison to a flow in the rolling direction. For each die configuration, there is some critical ratio L/H and corresponding roll radius R which is large enough to provide extrusion of all material into the die without any flow in the rolling direction. The critical ratio may be defined by experimentation or process simulation. For this situation, slipping between the material and the rolls is eliminated, the rolled product has the same length as the original billet, and the rolling reduction is $$\epsilon=1-h/H=V_v/V$$

where H is a thickness of the original billet, h is a minimal gap between the rolls, $V_c$ is a volume of the die cavities, and V is a billet volume. The same is true for any case when an actual ratio of billet/die contact area length to the billet thickness exceeds the critical ratio.

Figure 2:
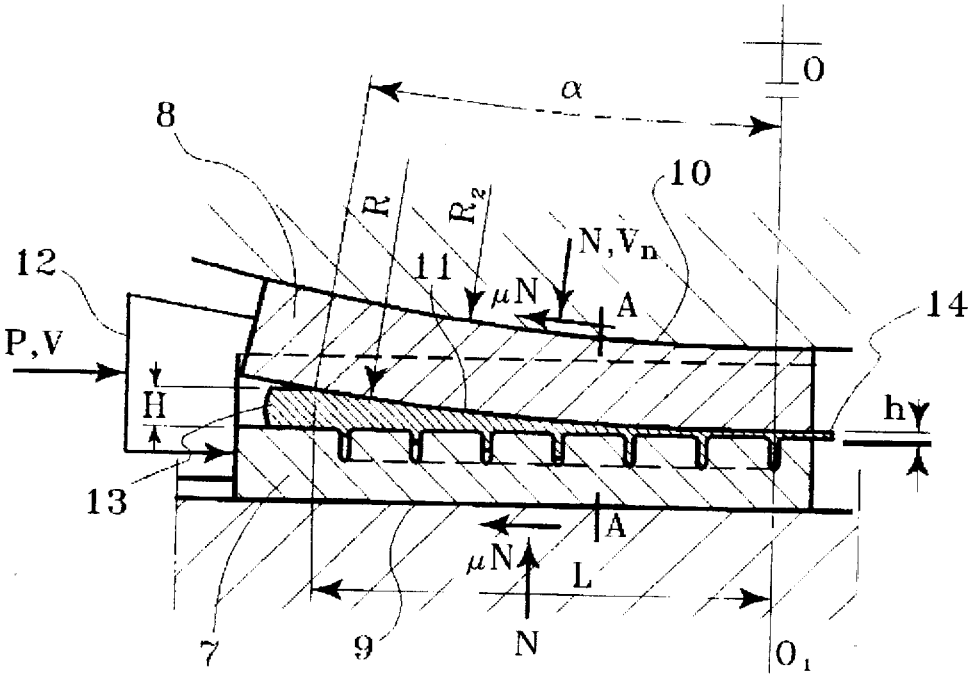
FIG. 2 shows a forging-rolling process between flat circular die blocks.
Figure 3:
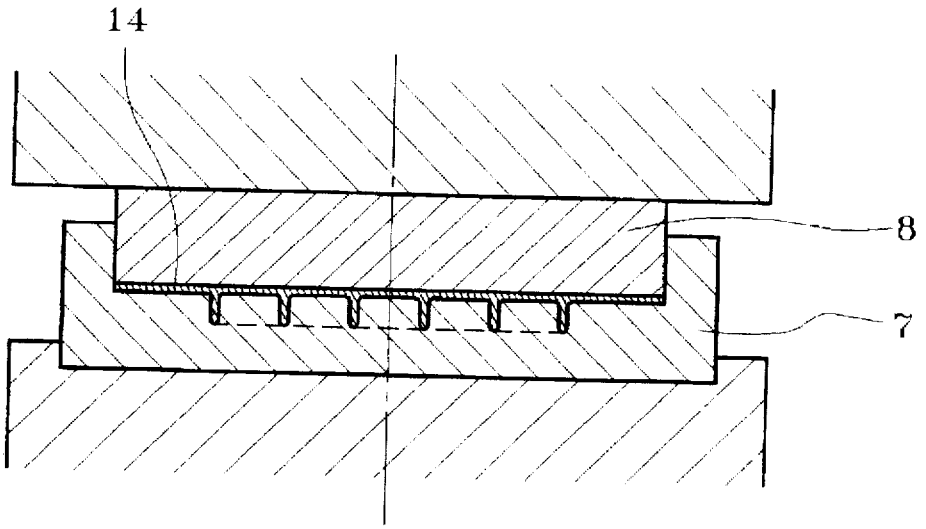
FIG. 3 is a cross-sectional view of Section A—A of FIG. 2.

In these cases a forging-rolling process is quite similar to an ordinary die forging, except that a load is applied not to all projection area of a forging but acts successively on relatively small areas. According to calculations and experiments, for typical applications such processing is achieved when a ratio of the contact area length L to the original billet thickness H is between 20 and 75, and a rolling angle $\alpha$ is less than a few degrees. A corresponding diameter of the rolls should be from 10 to 100 meters. As such large rolls can not be formed as a one piece body, in the most practical case (FIG. 2) a bottom die is a flat rectangular block 7, and a top die is a sectoral block 8 of the ring. The bottom die is movable along a plane guide surface 9 while the top die slides along a cylindrical guide surface 10 which is concentric to a circular die surface 11. The cylindrical surfaces, 10, 11 of large radii R and $R_2$ have the same center O located at axis $00_1$. During sliding along the surface 10, the die 8 rotates about this center similarly to a solid roll of the same large radius R. Both dies may be provided with sculptured cavities, and are driven into the rolling direction by a loading mechanism 12 of a press, that will be later described in more details. A billet 13 is inserted between dies and that way forged into a product 14. To prevent a material flow in the transverse direction, the dies 6, 7 form a semiclosed chamber shown in FIG. 3.

The process parameters are described by formulae:

$$R/H(M^2+\epsilon^2)/2\epsilon$$

$$\sin\alpha=2M\epsilon/(M^2+\epsilon^2)$$

where $\epsilon=1-h/H$ is a rolling reduction, and M=L/H is a relative length of the billet/die billet-tool contact area. For small rolling angles $\alpha$ there are simple relations connecting a press load P and a speed V to a normal force N and a speed $V_n$ between the dies 7, 8 (FIG. 2):

$$P\sim 2\mu N$$

$$V_n\sim\alpha V/2$$

where $\mu$ is a friction coefficient at the surfaces 9 and 10. With good lubricant $\mu<1$ and P<N. Therefore, the forging-rolling process provides a significant decrease of the press capacity in comparison with an ordinary die forging process. This effect may be increased by application of roller conveyors between the dies 7, 8 and the guides 9, 10 to replace sliding friction with rolling friction.

On the other hand, the rolling speed V is of about two orders in magnitude greater than the equivalent forging speed $V_n$. That increases productivity, improves process control, and presents opportunity for processing of superplastic, semisolid, low ductile, and other special materials.

Figure 4:
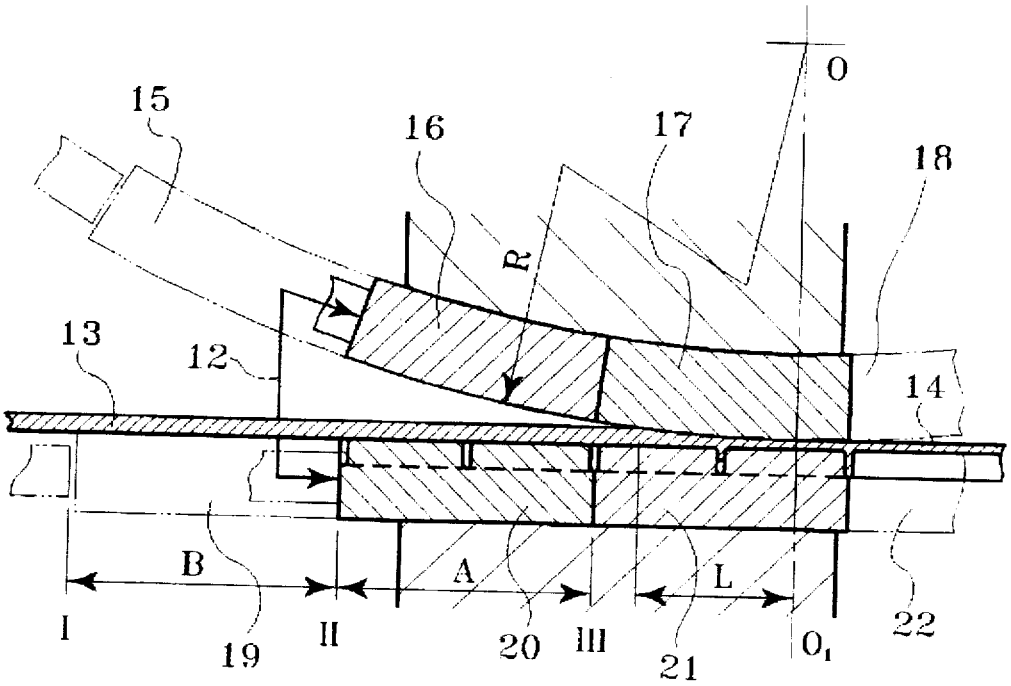
FIG. 4 shows a forging-rolling process between sectioned flat and circular die blocks.

Next embodiments of the present invention are targeted for fabrication of very long products with a length which exceeds the die length many times. For this purpose the dies are composed of a plurality of sectioned sectoral blocks of the ring and blocks such as 16, 17 and 20, 21 shown in FIG. 4. The blocks are periodically introduced into the working zone from the entry end of a billet 13. FIG. 4 shows a beginning stage of a working stroke A (position II). The blocks 17, 21 cover a billet contact area L. They are driven in the rolling direction by a loading mechanism 12 through additional die blocks 16, 20. The stroke A is equal to a length of the blocks. After completing the stroke (position III), the blocks 17, 21 leave the working zone whereas the blocks 16, 20 take their original position. At positions 18, 22, blocks 17, 21 are separated from a forged product 14 and transmitted to storage-preheating positions (not shown). The loading mechanism 12 retreats to position I, and two supplementary die blocks 15, 19 are put into operation. During a light running stroke B from position I to position II the loading mechanism 12 moves the new blocks 15, 19 to the previous position of the blocks 16, 20, and then performs a next working stroke. The same cycle is periodically repeated providing semicontinuous processing of the very long original billets 13. After preheating, the die blocks are recycled in the prescribed order. That way sets and orders of each die flocks way be arbitrary chosen to optimize processing of very long or continuous products with minimum numbers of blocks.

To fabricate panels with irregular patterns of integral stiffeners, variable thickness and curvature, sets of die elements are formed with variable configuration of die cavities and radii of curvature $\rho$ in the transverse direction. Also, the original billet may have variable thickness and width.

As it was pointed out, the forging-rolling method is especially effective for forming very thin and complicated panels from superplastic alloys because these alloys are currently available only in sheet forms. Conditions for superplastic forming are provided by controlling of a preheating temperature of a billet and dies, and a working speed of a press. Similarly, these parameters may provide conditions for forming materials in semisolid state.

Figure 5:
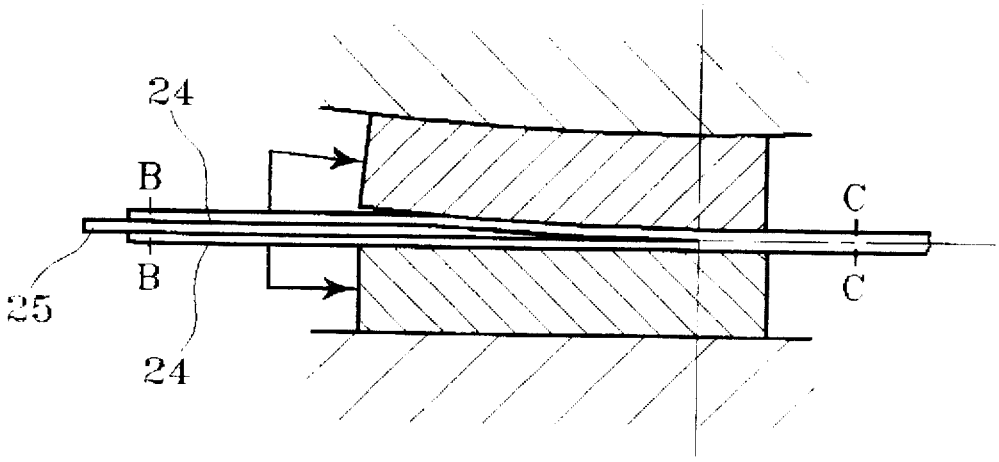
FIG. 5 shows forging-rolling processing of fibrous composite materials.
Figure 6:
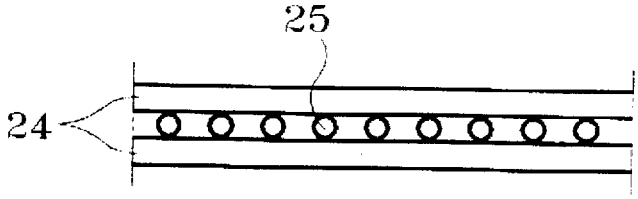
FIG. 6 is a cross-sectional view of Section B—B of FIG. 5.
Figure 7:
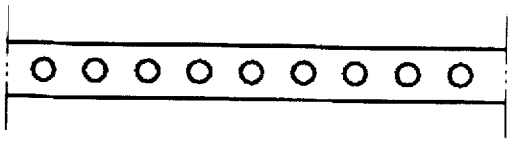
FIG. 7 is a cross-sectional view of Section C—C of FIG. 5.
Figure 8:
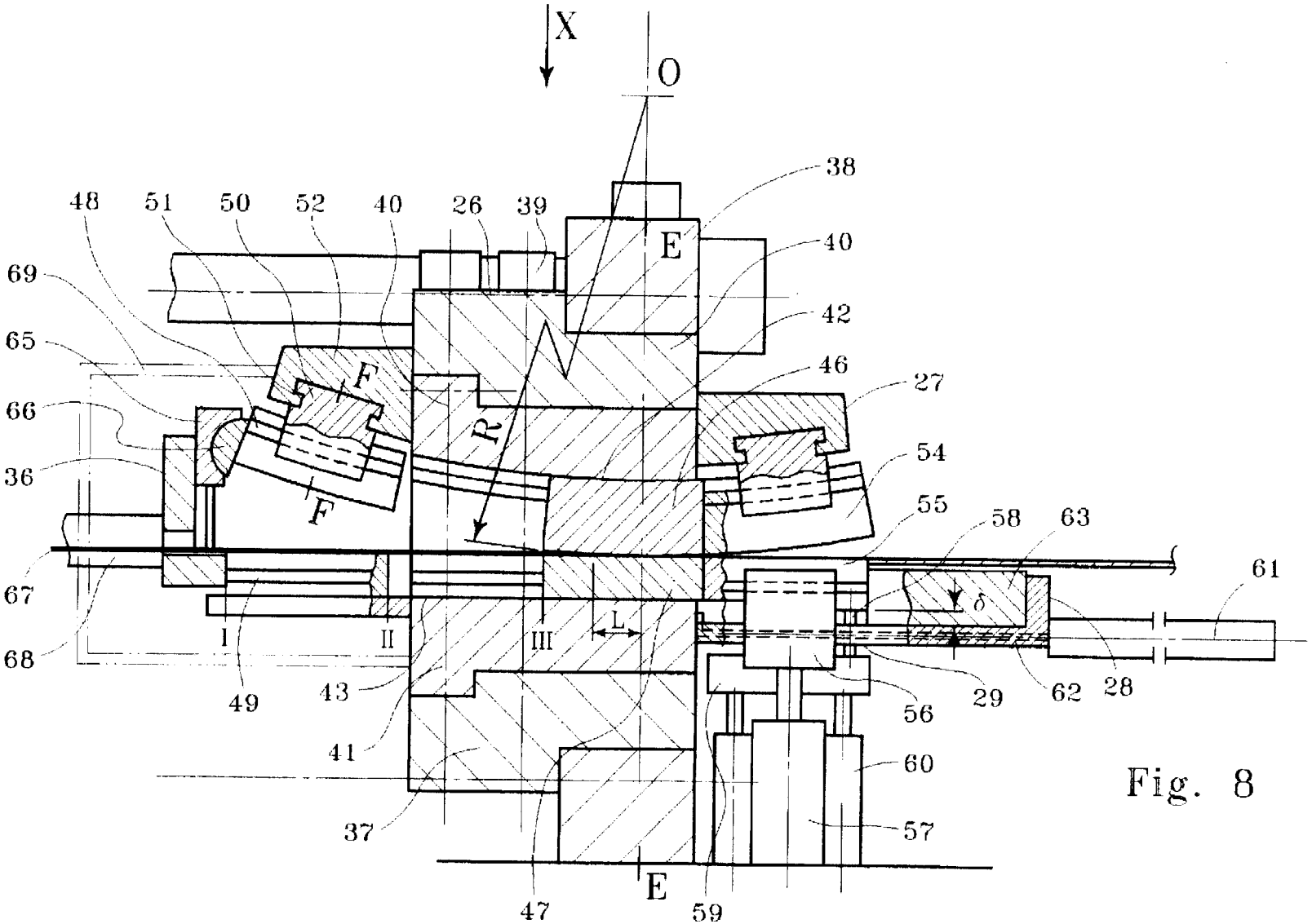
FIG. 8 is a longitudinal section of a forging-rolling apparatus corresponding to Section D—D of FIG. 9.
Figure 9:
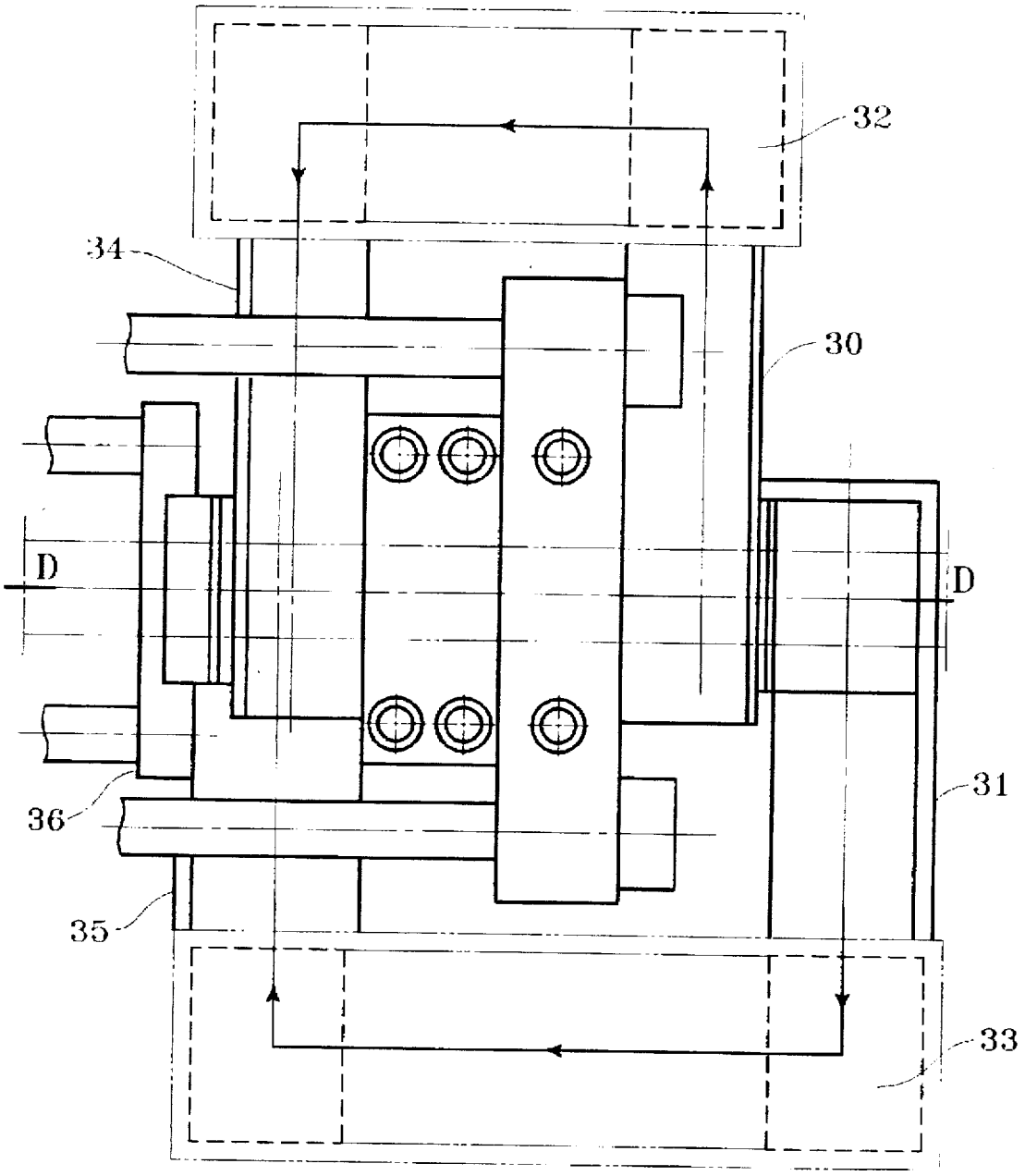
FIG. 9 is a view of a forging-rolling apparatus taken in the direction X of FIG. 8.

Another embodiment of the Invention for fabrication of composite material sheets by deformation welding of a matrix component 24 and continuous or discrete fibers 25 is presented in FIGS. 5, 6, 7. As a material elongation into the rolling direction is prohibited, the ductile matrix component 24 may flow only between the fibers 25. That way a solid material (FIG. 9) is produced without any fracture of high strength and brittle fibers. Necessary reduction to fabricate a full density product at an established temperature and press speed is:

$$\epsilon=(1+m)^{-1}$$

where m is a ratio of total thickness of all layers of the fiber component to total thickness of all layers of the matrix component at the original condition (FIG. 8).

Similarly, the invention can be also utilized for consolidation and bonding of powders. In that case the absence of a material flow in longitudinal and transverse directions together with a high pressure provide conditions of near isostatic pressure. Therefore, continuous flat products may be fabricated from low ductile sintered or canned powder billets.

An apparatus of the invention (see FIGS. 8–11) for realization of forging-rolling process at horizontal extrusion presses comprises a working unit 26, mechanisms 27, 28 for removal of die blocks after passing through a working zone, an ejection mechanism 29 of bottom dies, conveyors 30, 31 for displacement of the dies to storage-preheating positions, die heaters 32, 33, conveyors 34, 35 for transferring dies to the working zone, and a loading mechanism 36.

The working unit 26 is formed by a split frame 37 attached to a press traverse 38. Frame pieces are coupled together and to the traverse by prestrained studs 39. A top base 40 and a bottom base 41 are mounted inside the frame 37. The top base has a cylindrical guide surface 42 of large radius while the bottom base 41 has a flat guide surface 43. Also, the bases are provided with guide projections 44, 45 congruous to their guide surfaces 42, 43. Top and bottom die blocks 46, 47 slide along the guide surfaces 42, 43 of the bases 40, 41 and cooperate with projections 44, 45 by corresponding slots 48, 49. Friction between the dies and the bases is reduced by a solid lubrication system or by using top and bottom roller conveyors (not shown). Both the top and bottom dies may be provided with sculptured cavities. A more complicated configuration of die cavities is provided in the bottom dies. Also, top dies have greater angles of forging drafts to facilitate easy separation of the top dies from forgings and secure them in the bottom dies. If integral stiffeners are located on one side of the panels, a working surface of the top dies is even (this case is shown on FIGS. 2–4). For separation from the forgings, the bottom dies are provided with ejectors (not shown).

Figure 11:
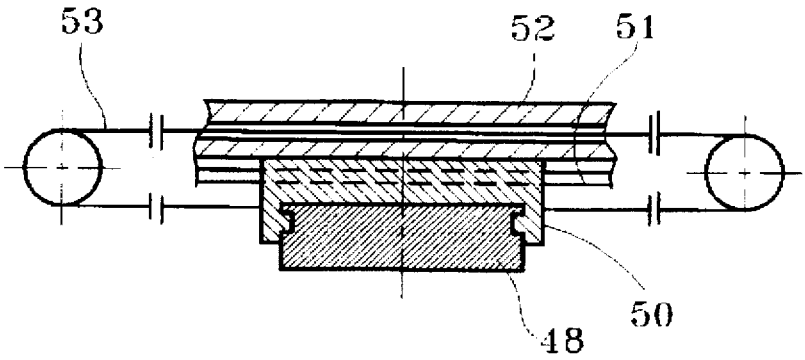
FIG. 11 is a cross-sectional view of Section F—F of FIG. 8.

Top die blocks 48 are delivered to the entry end of the working zone by a carrier 50 driven along a guide 51 of a beam 52 by a chain conveyor 53 (FIG. 11). The same system 27, 30 is used to remove the top dies 54 after leaving the working zone and transfer them to the storage-preheating position 32.

Similarly, the bottom dies 49 are put into the working zone by a conveyer 35. After leaving this zone, the bottom dies enter to an ejection position 55. In this position, they are fixed by a grip 56 provided with cylinders 57. Die ejectors cooperate with pins 58 mounted in a plate 59 operated by cylinders 60. For ejection of the forgings from the dies, the cylinders 57 shift a die block 55 down on the gap "δ" (see FIG. 8) while the cylinders 60 hold the plate 59, pins 58 and die ejectors in the top position. Then the cylinders 60 move the plate 59 with the pins 58 down on the same gap "δ", an additional cylinder 61 moves the die element 55 to a position 63 through a draft 52, a conveyer 31 transfer this block to the storage-preheating position 33 of the bottom dies, and the cylinders 57, 60, 61 return the grip 56, plate 58 and draft 62 to their original positions.

A working lead is applied to the dies by press plungers 68 through a transverse beam 36. The beam 36 acts directly on the bottom die elements and through a slider 65 and cylindrical pivot 65 acts on the top die elements. The slider 65 and the pivot 66 provide uniform loading of the top die elements at any position inside the working zone.

The original billet 67 is fed to the entering end of the working zone through a press window and a heater (not shown). A thermoisolation protection 69 conserves isothermal condition of the billet and the dies inside the working zone. Before entering this zone, the die blocks and the billet are automatically lubricated to promote a material flow into die cavities. The apparatus may be provided by a few sets of bases 40 of different radii. That way the process may be optimized by selection of the minimum rolling radius that guarantees quality products.

Figure 10:
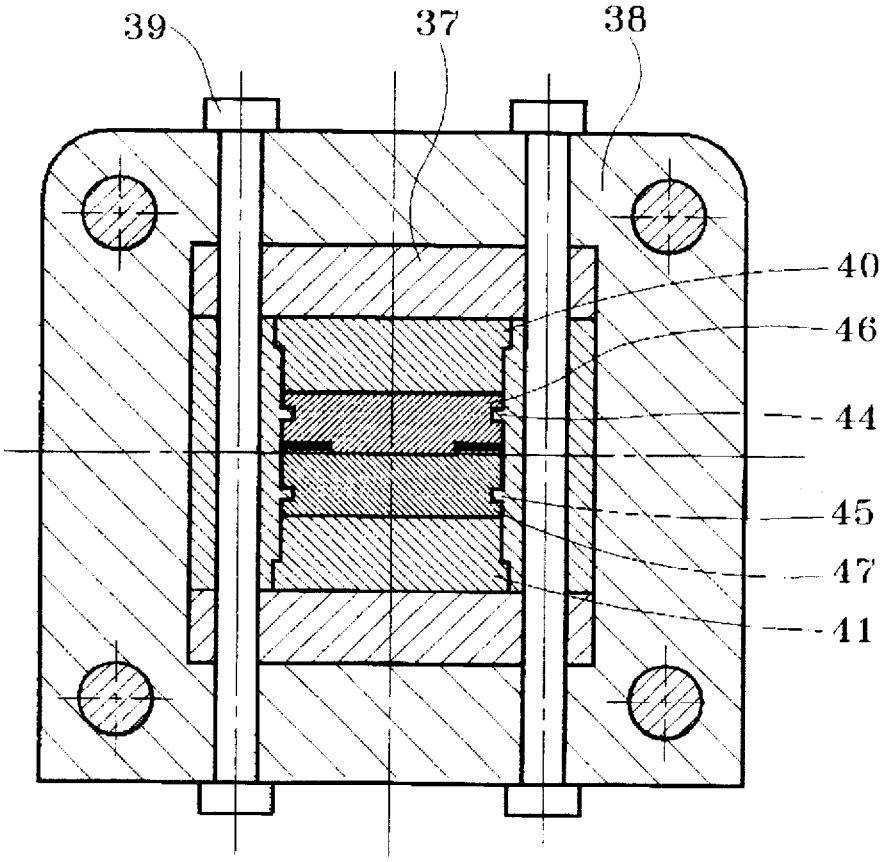
FIG. 10 is a cross-sectional view of Section E—E of FIG. 8.

At the beginning stage of the processing shown in FIG. 10, the loading mechanism 36 takes a limiting left position I, the two die blocks 46, 47 are located inside the working zone, and the two new blocks 48, 49 are fed to this zone. During a light running stroke, the press pushes the blocks 48, 49 in contact with the blocks 46, 47 (position II), performs a working stroke (position III), and retreats to the original position I. The top die block leaving the working zone is transmitted to the storage-preheating position 32. The corresponding bottom die block is separated from a forging in a position 55, moved to a position 63, and transmitted to the storage-preheating position 33 as it was described above. This working cycle is repeated a number of times.

The most important advantage of the invention deals with a shape of the processed parts. These parts are difficult or impossible to fabricate by other metal working operations. A panels length may be as large as 50 meters or more, while the width may be up to 1500 mm and the thickness only a few millimeters. Stiffeners may be located at one side or both sides of a panel, and may have regular or irregular cellular patterns. Also, a fabrication of panels of a variable width, thickness and curvature is possible.

Other advantages of the invention are that it may be applied to any light alloys, polymers and other materials at standard extrusion presses of a moderate capacity, the tool is simple and reliable, and the process is favorable for superplastic or semisolid forming as well as for producing flat billets and products of powder and composite materials.

What is claimed is:

1. A method of forging-rolling of billets between flat and circular sculptured dies which define a smoothly convergent working zone and contact area between the billet and dies, the method comprising the steps of determining a critical ratio of a contact area length to a billet thickness that prevents a material flow into a rolling direction and provides an extrusion of all material into die cavities; selecting a ratio of the contact area length to the billet thickness more than a critical ratio; forming a radius of the circular die in accordance with an expression: $R=H(M^2+\epsilon^2)/2\epsilon$ where H is the billet thickness:

M is the selected ratio of contact the contact area length to the billet thickness $\epsilon=V_c/V$ is a billet reduction, $V_c$ is a volume of die cavities, V is a billet volume.

2. A method as defined in claim 1, wherein said determining includes determining the critical ratio by experimentation.

3. A method as defined in claim 1, wherein said determining includes determining the critical ratio by simulation.

4. A method as defined in claim 1, wherein said selecting the ratio includes selecting the ratio of contact area length to the billet thickness from 20 to 75.

5. A method as defined in claim 1; and further comprising the steps of forming the flat die as a set of separate rectangular blocks sliding along a plane guide surface; forming the circular die as a set of separate sectoral blocks of a ring sliding along a cylindrical guide surface concentric to the circular die surface; determining sets and orders of the rectangular and sectoral die blocks of which the continuous flat and circular dies are successively composed from restricted numbers of the rectangular and sectoral blocks respectively; feeding a billet between the dies from an entry end of a working zone; periodically introducing a corresponding couple of the rectangular and sectoral blocks into the working zone from the entry end; semicontinuously pushing the die blocks through the working zone set-by-set to previously introduced blocks; separating the die blocks from a formed product after leaving the working zone; transmitting the leaving die blocks to a storage-preheating position; and recycling die blocks in the working zone in a prescribed order.

6. A method as defined in claim 1, particularly for fabrication of a composite material; and further comprising the steps of preparing a billet assembly containing a fibrous component arranged in layers between laminates of a matrix component; feeding the billet assembly between even flat and circular dies; and forging-rolling the billet assembly at corresponding temperature and speed with a reduction defined by expression:

$$\epsilon=(1\pm M)^{-1}$$

where M is a ratio of a total thickness of all layers of the fibrous component to a total thickness of all laminates of the matrix component.

7. An apparatus for forming a thin parts of large length and width by forging-rolling at horizontal extrusion presses, comprising a frame attachable to a stationary press traverse; bottom and top bases provided correspondingly with plane and cylindrical guide surfaces mounted in said frame at a fixed distance; a flat bottom die sliding along said plane guide surface and composed of separate rectangular die blocks arranged in a predetermined set and order; a circular top die sliding along said cylindrical guide surface concentric to a circular die surface and composed of separate sectoral die blocks arranged in a predetermined set and order; means for preheating and feeding a billet into a smoothly convergent working zone between set top and bottom dies; means for periodically introducing a successive couple of the rectangular and sectoral die blocks into a working zone from an entry end of a billet; means for periodically loading the die blocks from a movable press traverse and pushing them set-by-set to the previously introduced die blocks; means for separating the die blocks from a forged part after leaving the working zone; means for conveying the die blocks from the working zone to a storage-preheating position; means for periodically delivering a corresponding couple of the rectangular and circular die blocks to the entry end of the working zone in a prescribed order.

* * * * *